United States Patent [19]

Morrelli

[11] Patent Number: 4,964,353

[45] Date of Patent: Oct. 23, 1990

[54] WINDSURFER SAIL

[76] Inventor: Vincent A. Morrelli, 3953 Transport St., Ventura, Calif. 93003

[21] Appl. No.: 348,377

[22] Filed: May 8, 1989

[51] Int. Cl.[5] ..... B63H 9/06

[52] U.S. Cl. ..... 114/39.2; 114/90; 114/103

[58] Field of Search ..... 114/39.1, 39.2, 90, 114/102, 103; 244/123, 124

[56] References Cited

U.S. PATENT DOCUMENTS

| | | | |
|---|---|---|---|
| 3,130,944 | 4/1964 | Creasey et al. | 244/124 |
| 4,437,426 | 3/1984 | Latham | 244/123 |
| 4,735,429 | 4/1988 | Beck | 114/102 |
| 4,753,186 | 6/1988 | Paras | 114/103 |

FOREIGN PATENT DOCUMENTS

| | | | |
|---|---|---|---|
| 3119531 | 12/1982 | Fed. Rep. of Germany | 114/39.2 |
| 2510510 | 2/1983 | France | 114/39.2 |
| 2122561 | 1/1984 | United Kingdom | 114/39.2 |

*Primary Examiner*—Sherman Basinger
*Assistant Examiner*—Stephen P. Avila
*Attorney, Agent, or Firm*—Jack C. Munro

[57] ABSTRACT

A windsurfer sail where the top section of the mast of the sail is arcuately curved a substantial amount where the longitudinal center axis of the top edge of the mast is parallel to the upper surface of the sailboard. This top section of the mast is also capable of a limited amount of pivoting movement relative to the remaining portion of the mast so that the uppermost area of the sail can be oriented in the maximum wind-catching position.

6 Claims, 2 Drawing Sheets

3
10
12
14
16
17
18
20
22
24
26
28
29
30
32
34
36
38
40
42
43
44
45
46
47
48
49
50
51
53
55
56
57
58
60
62
64
72

WINDSURFER SAIL

BACKGROUND OF THE INVENTION

The field of this invention relates to sails for crafts that move on water and more particularly to a sail for a windsurfer.

Within recent years, a recreational vehicle has evolved for use on water which mounts a sail on a conventional surfboard. Windsurfers are gaining in popularity with many manufacturers manufacturing windsurfers. The competition between these manufacturers is growing. One way in which a competitive advantage has been achieved by a particular manufacturer is for that manufacturer to be able to claim that it manufactures the fastest windsurfer. A lot of money at a time is being spent to establish this claim.

Therefore, if a windsurfer can be improved upon, to where this particular windsurfer can be faster than all other types of windsurfers, such a windsurfer can be quite valuable within the current marketplace.

SUMMARY OF THE INVENTION

The primary objective of the structure of the present invention is to design a windsurfer sail which captures a greater amount of air than previous windsurfing sails and also moves through the air with less drag with the net result being increased speed in the windsurfer.

Another objective of the present invention is to construct a windsurfer sail which is non-complex in construction, and requires only minor modifications from conventional windsurfing sails.

The structure of the present invention has to do with modifying the tip portion of a mast so that it is directed rearwardly or downwind. The sail body is attached within the concave edge of the mast. It has been discovered that this orientation of the tip of the mast cuts through the air more efficiently. Additionally, the tip section of the mast, generally no more than two to three feet of the total length of the mast, is pivotally mounted by a pivot connection to the remaining portion of the mast. This tip section is permitted to pivot, approximately twenty to thirty degrees, relative to the remaining portion of the mast. It has been found that as the windsurfer sail moves through the air that this tip portion of the mast will automatically pivot to locate the sail body in the optimum wind-catching position. This tip portion may or may not be secured by a fastener to the remaining portion of the mast. This fastener, if utilized, limits the pivoting movement of the tip section relative to the remaining portion of the mast.

DETAILED DESCRIPTION OF THE SHOWN EMBODIMENT

Figures 1, 2:
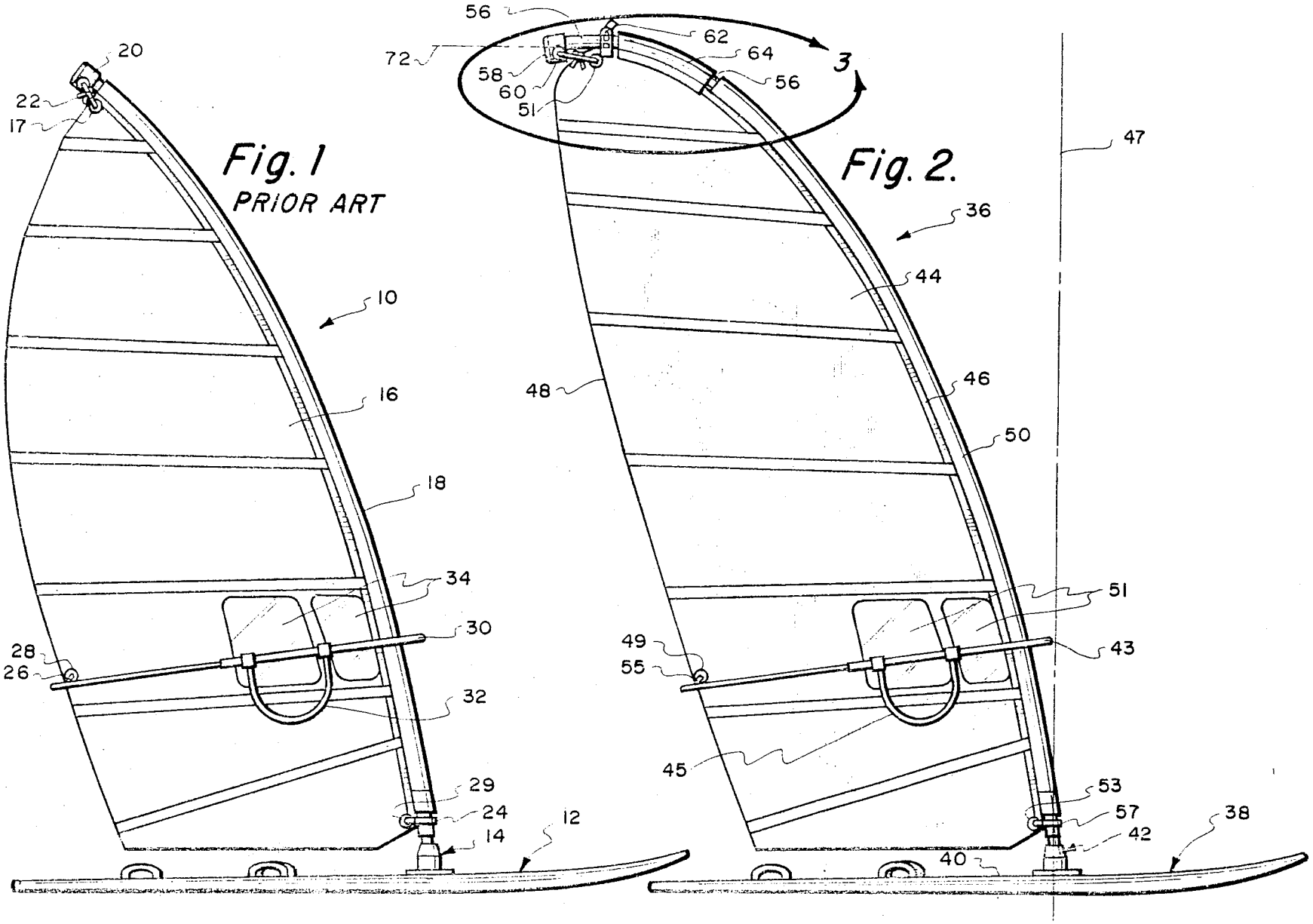
Fig. 1 PRIOR ART
FIG. 1 is a side elevational view of a typical windsurfer of the prior art.
FIG. 2 is a side elevational view similar to FIG. 1 but showing the windsurfer sail of the present invention.
Figure 3:
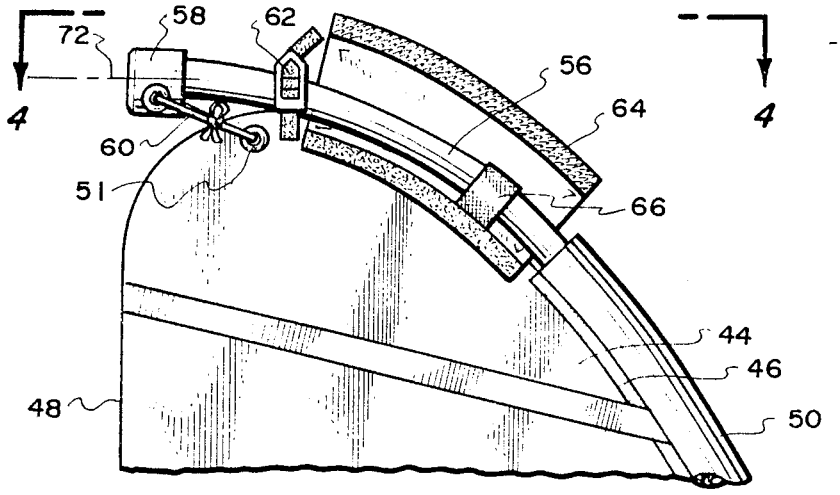
FIG. 3 is an enlarged view of the tip section of the mast of FIG. 2 taken along line 3—3 of FIG. 2 showing a fabric sleeve (in an open position) attached to the sail body which is normally mounted in an enclosing relationship around the tip portion of the mast.

Referring particularly to FIG. 1, there is shown a prior art windsurfer 10 which is composed generally of a sailboard 12, a mast 14, and a sail body 16. The mast 14 has a leading or luff edge 18. The upper end of the mast terminates in a bulbous portion which is referred to as a cap 20. Connected with the cap 20 is a tie-down string 22. The tie-down string engages with an eyelet 17 mounted within the sail body 16.

Included with the sail body 16 at the leech edge is an eyelet 28. Eyelet 28 is located directly adjacent the boom 30 which is to be handled by the operator and is to be used to effect steering of the windsurfer as it moves across the water. A tie-down string 26 connects eyelet 28 to boom 30. Mounted on the boom 30 is a graspable handle 32. Connecting the eyelet 29 to the mast 14 is a clamping ring 24. The sail body 16 includes a pair of windows 34 which are located directly adjacent the boom 30.

Referring particularly to FIGS. 2 through 6 of the drawings, there is shown the windsurfer 36 of this invention which includes a conventional sailboard 38 upon which there is mounted on the upper surface 40 of the sailboard 38 the mast 42 of this invention. The mast 42 has a longitudinal center axis 47 which is substantially perpendicular at the connection to the sailboard 38. Connecting with the mast 42 is a sail body 44 which has a leading edge defined as the luff edge 46. The trailing edge of the sail body 46 is defined as the leech edge 48. The sail body 44 is in essence an airfoil. Mounted across the sail body 44 is a boom 43 upon which is mounted a conventional handle 45. Included within the sail body are a pair of windows 51 so that the user will be able to see to the opposite side of the sail body 44 when the windsurfer 36 is being operated. The sail body 44 includes a fabric sleeve 50 to enclose the luff edge of the mast 42. The sail body 44 also includes an eyelet 49 at the leech edge 48. A tie-down string 55 connects eyelet 49 to boom 43. A clamping ring 57 connects eyelet 53 to the mast 42.

Formed within the sail body 44 is an eyelet 51. Connecting the eyelet 51 is a tie-down 60 which connects to the cap 58. The cap 58 is mounted on a pre-bent tip tube which is defined as a tip section 56. Connecting between the tip section 56 and the sail body 44 is a tie-down strap 62.

A second tie-down strap 66 is mounted about the tip section 56 and is located spaced some distance from the tie-down strap 62. Covering the tie-down strap 66 and most of the tip section 56 is a covering sleeve 64. This covering sleeve 64 includes strip fasteners which is commonly sold under the tradename of Velcro in order to tightly secure the sleeve 64 in position. The sleeve 64 is similar in construction to the sleeve 50 which surrounds the remaining portion or main section of the mast 42.

The tie-downs 60, 62 and 66 are tightened sufficiently to orient the longitudinal center axis 72 at the leech edge 48 to be substantially parallel to the upper surface 40 of the sailboard 38. This position has been found to be the most efficient in moving through the wind.

Figure 4:
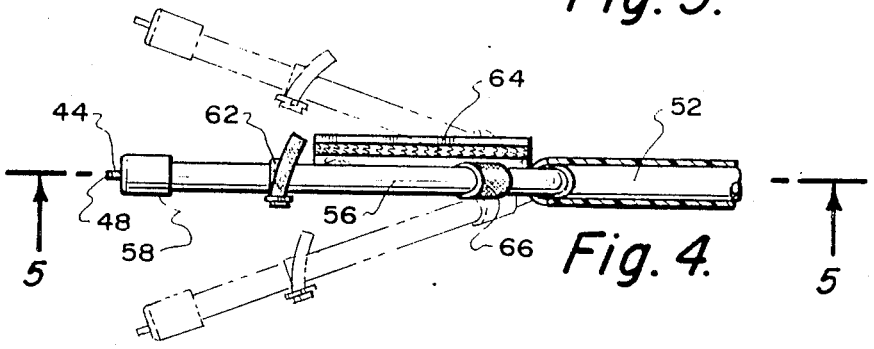
FIG. 4 is a top plan view of the tip portion of the mast of the present invention taken along line 4—4 of FIG. 3.
Figure 5:
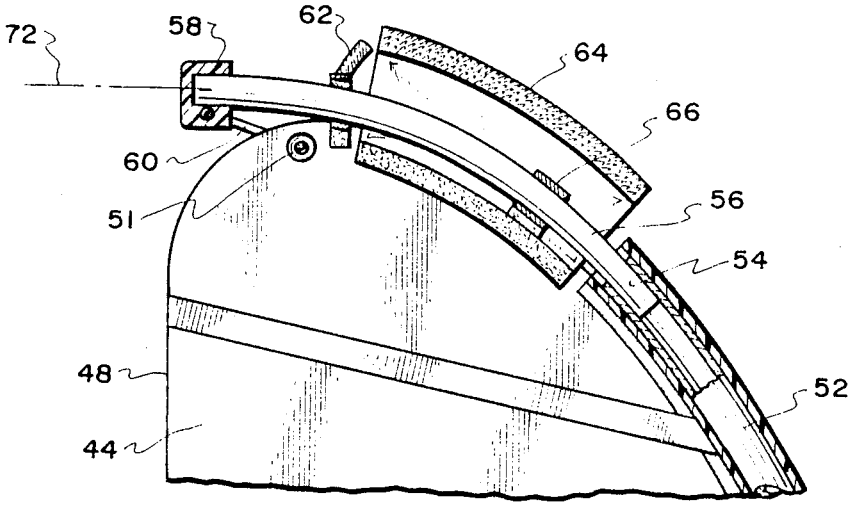
FIG. 5 is a cross-sectional view taken along line 5—5 of FIG. 4 showing more clearly the pivot joint arrangement utilized within the mast of the present invention.
Figure 6:
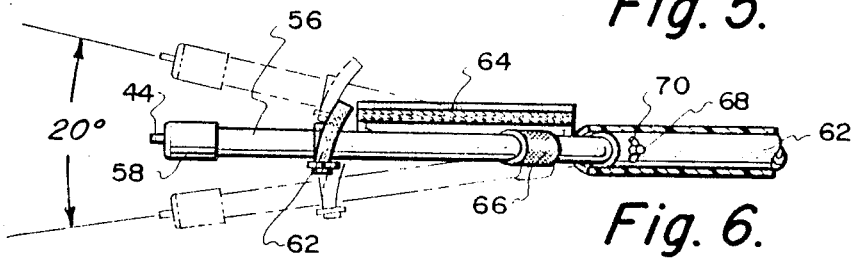
FIG. 6 is a view similar to FIG. 4 but of a modified form of the mast of the present invention.

This upper end of the main section of the mast 52 includes a cylindrical recess 54. Within this recess 54 is mounted the tip section 56. This tip section 56 can just be located within the recess 54 which would permit tip section 56 to pivot approximately thirty degrees as shown in FIG. 4 of the drawings in reference to the dotted line positions of the tip section 56. If it is desired to limit the amount of this pivoting movement, to say twenty degrees of movement, there may be included between the main section of the mast 52 and the tip section 56 a bolt 68. The bolt 68 can be fixed to the tip section 56. The body of the bolt 68 rides within a slot 70 formed within the main section of the mast 52. The length of the slot 70 is selected to limit the amount of this movement to twenty degrees. Limiting of this pivoting movement will prevent the tip section 56 from pivoting more than desired which could happen in a strong gust of wind.

Obviously, the shorter the length of the slot 70 the more limited the amount of movement of the tip section 56. In referring to FIG. 4, there is shown no connection between the tip section 56 and the main section of the mast 52. In the tying of the sail body 44 to the mast 42, this tie-down force inherently tends to prevent excessive pivoting between the tip section 56 and the main section 52. If it is desired to secure together the main portion 52 and the tip section 56, such can be accomplished by the using of the bolt 68.

It has been found that during operation of the windsurfer sail 36 of this invention that the tip portion will automatically freely pivot slightly relative to the main portion of the mast 52. This twisting of the tip section 56 will help to locate the upper portion of the sail body in the maximum wind-catching position as the various wind conditions change. This amount of twist of the tip section 56 can be controlled by adjusting the force of the tie-down 60, the tie-down 66, or tie-down 55. Tightening of the leech, in other words making the sail more taut, will have the tip section 56 twist less and reduce the camber in the top half of the sail body 44. This is to be used in lighter winds. Tightening of the tie-down 66 will tend to create a loose leech and the tip section 56 will twist more and slightly increase the camber in the top half of the sail body 44. This position is to be used in medium winds. Loosening of the tie-down straps 56 will create a tight leech edge 48 and the tip section 56 will twist less reducing the camber in the top half of the sail body 44. This is to be used in heavier winds. If the clew, which is located at eyelet 49, is tightened, there will be created a tight leech edge 48. The tip section 56 will twist less and reduce the camber of the bottom half of the sail body 44. This is to be used in intermediate and heavier winds and is to be for the purpose of reducing drive in the lower half of the sail body 44. Loosening of the eyelet 49 will create a loose leech edge 48. The tip section 56 will twist more and increase the camber in the bottom half of the sail. This will be used in lighter winds and will be for use to increase the drive in the lower half of the sail body 44. If the tack of the sail body 44 is tightened, the leech edge 48 will be loosened. As a result, the tip section 56 will twist more and decrease the camber at the top half of the sail. This will be used in intermediate to heavier winds. If the tack is loosened, the leech edge 48 will be tightened and the tip section 56 will twist less and increase the camber in the top half of the sail. This is to be used in lighter winds.

Although the structure of this invention is described in conjunction with a windsurfer sail, the structure could be embodied in any sail such as for a sailboat or an iceboat. Further, the concept of this invention could be included within any airfoil such as a wing of a hang glider or aircraft.

What is claimed is:

1. A sail for a windsurfer, said windsurfer including a sailboard adapted to float on water, said sailboard having a substantially planar upper surface on which a human operator is to stand, said sail having a sail body, said sail body having a foot edge, said foot edge being located directly adjacent said sailboard, said sail body having a luff edge and a leech edge, a mast, said mast defining a main section and a tip section, said tip section located at said free end of said mast, said sail body attached to said mast at said luff edge, the improvement comprising:

said tip section having a first longitudinal center axis, said tip section intersects said leech edge, at said intersection with said leech edge said first longitudinal center axis being substantially parallel to said upper surface of said sailboard; and said main section having a second longitudinal center axis, said mast being smoothly arcuately shaped.

2. The sail as defined in claim 1 wherein:

said tip section being pivotally mounted relative to said main section, said first longitudinal center axis of said tip section at said leech edge being substantially perpendicular to said second longitudinal center axis at the connection to said sailboard.

3. The sail as defined in claim 2 wherein:

securing means connecting said tip section and said main section, said securing means for preventing separation of said tip section and said main section but yet permitting pivoting of said tip section a limited amount relative to said main section.

4. A sail for a windsurfer, said windsurfer including a sailboard adapted to float on water, said sailboard having a substantially planar upper surface on which a human operator is to stand, said sail having a sail body, said sail body having a foot edge, said foot edge being located directly adjacent said sailboard, said sail body having a luff edge and a leech edge, a mast, said mast defining a main section and a tip section, said tip section located at said free end of said mast, said sail body attached to said mast at said luff edge, said mast being arcuately shaped, the improvement comprising:

said tip section having a first longitudinal center axis, said tip section intersects said leech edge, at said intersection with said leech edge said first longitudinal center axis being substantially parallel to said upper surface of said sailboard;

said tip section being pivotally mounted relative to said main section, said main section having a second longitudinal center axis, said first longitudinal center axis of said tip section at said leech edge being substantially perpendicular to said second longitudinal center axis at the connection to said sailboard;

securing means connecting said tip section and said main section, said securing means for preventing separation of said tip section and said main section but yet permitting pivoting of said tip section a limited amount relative to said main section; and said limited amount being approximately twenty degrees.

5. An airfoil comprising:

an airfoil body having a leading edge and a trailing edge, said airfoil body being separated into a tip section and a main body section, said tip section having an outer free edge defined as a tip edge, said tip edge interconnecting said leading edge and said trailing edge, said main body section having a base edge, said base edge being of a greater length than said tip edge, said tip edge having a first longitudinal center axis, said first longitudinal center axis being substantially parallel to said base edge, said main section having a second longitudinal center axis at said leading edge, said airfoil body being smoothly arcuately shaped.

6. The airfoil as defined in claim 5 wherein:

said tip section being pivotally mounted relative to said main body section, said first longitudinal center axis of said tip section at said trailing edge being substantially perpendicular to said second longitudinal center axis at the connection to said base edge.

* * * * *